US005089325A

United States Patent [19]

Covey

[11] Patent Number: 5,089,325

[45] Date of Patent: Feb. 18, 1992

[54] PARTIALLY COATED FABRIC SHEET

[75] Inventor: James F. Covey, Snohomish, Wash.

[73] Assignee: The Boeing Company, Seattle, Wash.

[21] Appl. No.: 651,047

[22] Filed: Feb. 4, 1991

Related U.S. Application Data

[60] Division of Ser. No. 146,418, Jan. 21, 1988, Pat. No. 4,892,626, and a continuation of Ser. No. 422,570, Oct. 17, 1989, abandoned.

[51] Int. Cl.[5] ..... B32B 7/00

[52] U.S. Cl. ..... 428/246; 428/248; 428/250; 428/260; 428/263; 428/408; 428/922

[58] Field of Search ..... 428/260, 262, 263, 378, 428/408, 246, 248, 250, 922

[56] References Cited

U.S. PATENT DOCUMENTS

| | | | |
|---|---|---|---|
| 653,887 | 7/1900 | Robertson . | |
| 1,243,041 | 10/1917 | Clark . | |
| 1,750,831 | 3/1930 | Carns . | |
| 1,819,130 | 8/1931 | Smith . | |
| 2,042,030 | 5/1936 | Tainton | 204/6 |
| 2,538,317 | 1/1951 | Mason et al. | 204/28 |
| 2,783,193 | 2/1957 | Nieter | 204/15 |
| 3,697,399 | 10/1972 | Usui | 204/15 |
| 3,888,745 | 6/1975 | Hojyo | 117/37 R |
| 4,278,435 | 7/1981 | Ebneth | 428/263 |
| 4,349,859 | 9/1982 | Sanders | 361/218 |
| 4,429,341 | 1/1984 | King | 361/117 |
| 4,479,163 | 10/1984 | Bannink, Jr. et al. | 361/218 |
| 4,522,889 | 6/1985 | Ebneth et al. | 428/614 |
| 4,727,451 | 2/1988 | Covey | 361/218 |
| 4,892,626 | 1/1990 | Covey | 204/15 |

FOREIGN PATENT DOCUMENTS

| | | |
|---|---|---|
| 1640496 | 10/1970 | Fed. Rep. of Germany . |
| 1208959 | 10/1970 | United Kingdom . |
| 1272777 | 3/1972 | United Kingdom . |

*Primary Examiner*—James J. Bell
*Attorney, Agent, or Firm*—John C. Hammar

[57] ABSTRACT

In a method for plating one side of a woven fabric sheet, a backing layer is applied to one side of the sheet. The sheet and backing layer are wetted in an electrolytic solution containing metallic ions to be deposited on one side of the fabric sheet only. Air bubbles trapped in interstices of the fabric weave and beneath the backing sheet prevent the electrolytic solution from soaking through the fabric sheet. Electrodes bond the metal ions on the wetted fabric thereto. The backing sheet is then removed. The resulting fabric is coated only on one side and the interstices are not filled in by plating material. The fabric is useful as the outermost layer in a composite laminate for an aircraft skin.

18 Claims, 1 Drawing Sheet

PARTIALLY COATED FABRIC SHEET

STATEMENT OF GOVERNMENT INTEREST

The Government of the United States has certain rights in this invention.

CROSS REFERENCE TO RELATED APPLICATIONS

This application is a continuation of my co-pending application Ser. No. 07/442,570 filed Oct. 17, 1989, entitled METHOD FOR PLATING ONE SIDE OF A WOVEN FABRIC SHEET, which has a divisional application of my prior application Ser. No,. 07/146,418, filed Jan. 21, 1988 under the same title.

TECHNICAL FIELD

The invention relates to composite structures for aircraft which dissipate electrical discharges.

BACKGROUND ART

A continuing concern in the aerospace industry is the design of aircraft which safely dissipate natural electric discharges. In a previous era when aircraft were primarily constructed from materials having uniform electrical conductivity characteristics, such as metal, the problem of safely dissipating electrical discharges was not particularly troublesome. However, with the increasing use of composite materials such as graphite fiber/epoxy resin in conjunction with metal structural elements, safe dissipation of electrical discharges in aircraft has become increasingly difficult to achieve.

Modern composite aircraft typically utilize woven sheets of graphite fiber material or tape which are impregnated with a resinous material such as epoxy. These sheets are then bonded together so as to form a lightweight laminate having considerable structural strength.

It is well known that the uppermost layer of the laminate may be provided with a quantity of metal to prevent electrical discharges from traveling through deeper layers of the laminate and to dissipate the discharge throughout the surface of the aircraft skin. As is also known from my U.S. patent application Ser. No. 000,926, titled "Metallic Conduction Method and System for Joined Sections of Composite Structures," different quantities of metal per unit area may be advantageously deposited in the uppermost layer of different areas of the aircraft to both maximize lightning protection and minimize the weight of the aircraft. For example, 200 grams per square meter of metal deposited in the outermost layer of an aircraft structure subject to a Zone One lightning strike is sufficient to prevent delamination of the aircraft skin. Furthermore, deposition of 100 grams per square meter of metal in an outermost layer of the aircraft subject to a Zone Two lightning strike is sufficient to protect that portion of the aircraft.

In a first prior art method for introducing metal into the fabric of a composite aircraft outermost layer, metal threads are woven into the graphite fabric at regular intervals. While this prior art technique has been proven satisfactory for lightning protection in most cases, it is evident that two different types of fabric having different metal thread counts will be required for zone two and zone 1 areas of an aircraft.

In a second prior art technique for introducing metal into the outermost layer of an aircraft skin, each fiber of the outermost layer is coated with metal prior to being woven into a continuous sheet. This technique is particularly disadvantageous in that the coaxial metal sheath around each fiber has a substantially different modulus of elasticity than the fiber itself. Thus, when he aircraft is subject to bending moments, the metal sheath tends to shear away from the fiber. In addition, unnecessary excess weight is introduced into the fabric weave.

In a third prior art method, described in U.S. Pat. No. 2,042,030, issued to Tainton, one side of a fabric sheet is coated with a relatively thick, metallized layer. This method was not adopted primarily for lightning protection of aircraft but was probably intended to provide a strong, waterproof covering for aircraft in an era when the aircraft fuselage and wings were covered with fabric. In this method, a cathode rotates in an electrolytic solution containing a metal ion to be deposited on one side of the fabric. The rotating cathode is negatively charged and thus attracts a thin coating of metallic ions (such as copper) onto the surface of the cathode. A fabric sheet is then pressed against the rolling cathode, and the metal layer is transferred to the outside of the fabric sheet in a fashion similar to paint being deposited on a wall with a roller. This technique results in the entire side of the fabric being coated with metal, including the interstices between each fiber. A metallized fabric of this type would have a metallized layer which is much thicker than necessary for lightning protection. As previously stated, in a Zone Two strike area, a metal content of approximately 100 grams per square meter is desired. This corresponds to a continuous copper sheet having a thickness of less than 25 $\mu$M. The plating technique disclosed in Tainton would not be capable of consistently providing such a thin coating. In addition, interstices in the weave would be filled in, which would disadvantageously interfere with the flex characteristic of the underlying composite material.

Therefore, a need exists for a plating technique which can deposit a very thin layer on one side of a woven fabric sheet and which does not fill in the interstices in the fabric weave.

SUMMARY OF THE INVENTION

It is an object of the present invention to provide a method for plating one side of individual fibers in a fabric sheet with a conductive material.

It is also an object of the present invention to achieve the above object with an apparatus which can conveniently control the thickness of the metal deposition.

The invention achieves these and other objects by applying a removable backing to one side of a fabric sheet. The fabric sheet is then wetted on the other side with an electrolytic solution containing metallic ions to be deposited on the fabric sheet. Air bubbles trapped in the interstices of the fabric weave by the removable backing prevent the solution from soaking through the weave and limit the wetted surface to a lower peripheral surface of each fiber in the weave. In a subsequent step, electrodes apply an electrical field across the sheet which bonds the metallic ions to the lower peripheral surfaces of the fibers. The backing sheet is then removed. The result is a fabric sheet having a thin, metallic coating on only one side of the individual fibers in the weave. The interstices are not filled in. The sheet is thus low in weight and retains flexibility characteristics substantially similar to those of an unplated sheet.

In the preferred embodiment, one of the electrodes is a conductive roller having a lower portion immersed in an electrolytic solution bath and an upper portion in contact with the lower peripheral surfaces of the fibers. A second electrode, comprising a conductive brush, is positioned in contact with the fabric sheet. An electric potential is impressed between the electrodes to bond the metal ions to the fiber surfaces. The quantity of metal deposited is controlled by the ionic concentration of the solution, the voltage impressed across the electrodes, and the current flow between the electrodes.

The fabric and backing sheets are preferably immersed in the electrolytic solution prior to introduction between the electrodes. The fabric and backing sheets are oriented so that air bubbles are trapped in the interstices within the weave. The fabric and backing sheets are also drawn under a weave opening roller in the solution, which opens up the weave to fuly wet the lower peripheral surfaces of the fibers. The conductive roller which comprises the first electrode may also be covered with fabric to absorb the electrolytic solution from the bath to ensure a good conductive path from the roller to the fabric sheet.

BEST MODE FOR CARRYING OUT THE INVENTION

Figure 1:
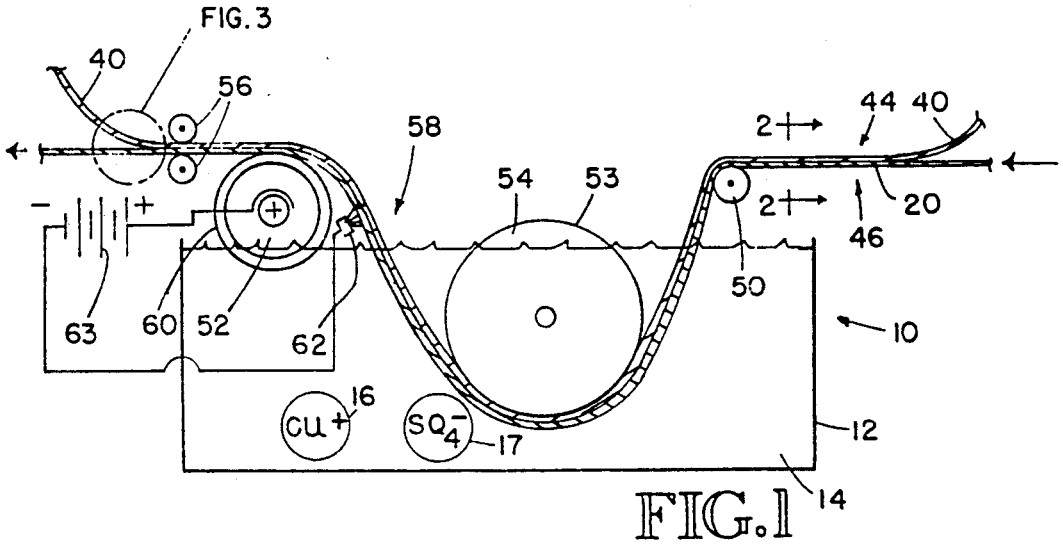
FIG. 1 is a schematic, cross-sectional view of a plating apparatus which utilizes the method of the present invention.

A plating apparatus for use with the method of the present invention is generally indicated at reference numeral 10 in FIG. 1. The apparatus includes a bath 12 of electrolytic solution 14. The solution contains copper and sulfate ions 16, 17 and various buffers. Other electrolytes having different metallic ions may be used as desired. The bath 12 is the source of copper ions 16 which are to be deposited onto one side of a woven, graphite fabric sheet 20, shown in FIGS. 1-3.

Figure 2:
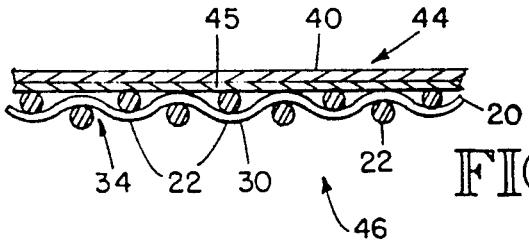
FIG. 2 is a cross-sectional view of the fabric and backing sheets taken along line 2—2 of FIG. 1.
Figure 3:
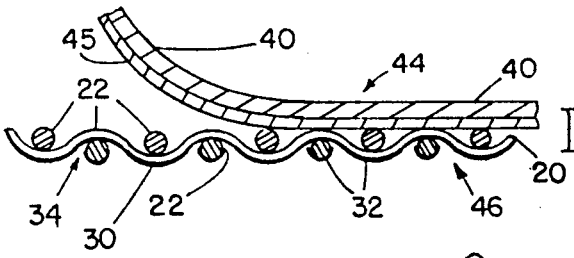
FIG. 3 is an enlarged view of circled area 3 in FIG. 1.
Figure 4:
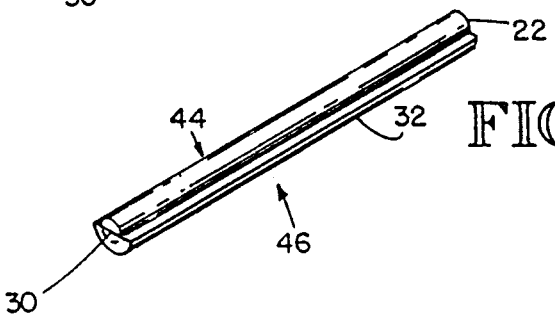
FIG. 4 is an enlarged view of a single fiber of the fabric sheet shown in FIG. 1 which has been plated on a lower peripheral surface by the method of the present invention.

The fabric sheet 20 consists of a plurality of individual fibers 22 which are interwoven as shown in FIGS. 2 and 3. The method of the invention preferably plates only a lower surface 30 (see FIG. 4) of each fiber 22 with a thin coating of copper 32. The coating may be as thin as 25 M or less. The coated side of the fabric will then be positioned on the outside of an uppermost layer of a composite laminate to distribute electrical discharges along the outside of an aircraft's skin.

The plating technique of the present invention preferably does not fill in interstices 34 between the individual fibers 22, as does the technique disclosed in U.S. Pat. No. 2,042,030, issued to Tainton. Such "filling in" of the interstices would result in a fabric sheet having flex characteristics substantially different from those of an unplated sheet. Also, unnecessary weight would be introduced into the sheet.

To promote the deposition of a thin coating 32 as described above, an adhesive backing sheet 40 is temporarily adhered to an upper side 44 of the fabric sheet which is not to be plated. The backing sheet may be ordinary paper adhered to the fabric sheet with a thin layer of rubber cement 45. The underside 46 of the fabric sheet 20 is positioned above the solution 14 so that upon introduction of the fabric and backing sheets into the solution, air bubbles are trapped in the interstices 34 of the fabric weave. In this way, only the lower peripheral surfaces 30 of the individual fibers 22 are wetted by the solution 14 containing the copper ions 16.

The fabric 20 and backing 40 sheets are introduced into the bath 12 over an idler roller 50, which, in conjunction with an anode roller 52 (described in more detail below), causes tension in the fabric sheet as it is guided around the periphery of an expansion roller 54. The expansion roller is substantially immersed in electrolytic solution 14 and serves only to open the weave of the fabric sheet 20 so that the lower peripheral surfaces 30 of each individual fiber 22 are thoroughly wetted with the solution. Drive rollers 56 draw the sheets to the left, as shown in FIG. 1, and provide the described tension in the sheet.

Upon emerging from the bath 12 at arrow 58, the backing sheet 40 and lower peripheral surface 30 of the fibers 22 in the fabric sheet 20 are thoroughly wetted with solution. The fabric and backing sheets are then guided through the anode roller 52 and a conductive cathode brush 62 as shown. The anode roller has a portion in contact with the solution 14 and a portion in contact with the underside 46 of the fabric sheet 20. The anode roller is preferably made from a conductive material (such as graphite) which will not be consumed during the plating process. The anode roller 52 may be provided with a peripheral sheet of fabric 60, such as Dacron ® felt, to ensure that the lower peripheral surfaces 30 of each fiber 22 are thoroughly wetted. The cathode brush 62 is positioned so as to be in contact with the wetted fabric sheet 40.

A voltage is impressed between the anode roller 52 and cathode brush 62 by a battery 63 or other voltage source to positively charge the former and negatively charge the latter. In this way, the copper ions 16 present on the lower peripheral surfaces 30 of the individual fibers 22 are bonded thereto. The backing sheet 40 may then be removed, as shown in FIGS. 1 and 3. The resulting plated fabric sheet may then be utilized in the outermost layer of a composite laminate, as discussed above.

As is well known to those of ordinary skill in the art, the quantity of metal deposited onto the fabric sheet 20 is a function of the electrolytic solution 14 concentration, the voltage impressed by battery 63, and the effective surface area of the anode roller 52. In the preferred embodiment, the voltage applied by battery 63 is variable between 8 to 12 volts, resulting in current flow of between 20 to 70 amperes, depending on the solution concentration. A suitable electrolytic solution using copper sulfate pentahydrate as the electrolyte is available from Selectron Corp. (Vanguard Pacific), Waterberry, Conn., which provides an amp hour rating for the solution. The anode roller 52 and cathode brush 62 shown in FIG. 1 have a length of approximately 24 inches, resulting in an effective anode contact area of 1½ inches by 24 inches. The rating of the solution divided by the applied voltage multiplied by the current flow from anode to cathode, multiplied by the time of current application, will give the amount of copper deposited.

Other embodiments and variations of the invention are contemplated. For example, while it is desirable to completely immerse the fabric sheet 20 and backing sheet 40 in the solution about the periphery of the expansion roller 54, it is believed that similar, although less favorable results could be attained even if the sheets are not fully immersed in the bath and even if the weave of the fabric sheet is not opened by expansion roller 54. Therefore, the invention is not to be limited by the above description but is to be determined in scope by the claims which follow.

I claim:

1. An electrical discharge resistant multi-layer composite material laminate structure for external use on an aircraft, comprising:

an outermost laminate layer having a plurality of woven fibers having intersects therebetween and having a thin coating of electrically conductive material only on one side thereof wherein the interstices are not coated with the electrically conductive material; and a plurality of additional uncoated layers bonded together and bonded with the outermost layer so as to form the composite material laminate structure.

2. The outermost layer of claim 1 wherein the thin coating of electrically conducting material has a plurality of thicknesses.

3. A partially coated fibrous fabric sheet, comprising;

a woven fabric sheet made from a plurality of individual fibers, the sheet having first and second sides and the fibers defining interstices within the fabric weave, the first side of the sheet having a plate thin metal coating substantially without any coating in the interstices and the second side of the sheet being substantially free of any plating which would inhibit use of the sheet in a composite laminate structure because of unnecessary weight.

4. The partially coated sheet of claim 3, wherein the coating is copper and has a thickness of 25 micrometers or less.

5. The partially coated sheet of claim 4 wherein the fibers are graphite.

6. A fabric comprising woven graphite fibers arranged as weave and warp fibers defining openings between adjacent fibers of the weave or warp, respectively, each fiber including a continuous coating of plated copper on one portion and an unplated portion to substantially minimize the weight of the resulting fabric while retaining substantially the same flex characteristics as an uncoated fabric, the copper providing sufficient conductivity so that the fabric can be used as the outermost layer of a composite laminate on an aircraft to provide Zone Two lighting protection.

7. The fabric of claim 6 wherein the fabric includes at least about 100 gms/$m^2$ copper.

8. The fabric of claim 6 further comprising a paper backing sheet adhered to the fabric with rubber cement on the unplated portion.

9. A partially coated fibrous fabric sheet made by a process comprising steps of:

removably attaching a flexible backing sheet to an upper side of a fabric sheet having individual fibers woven so as to form interstices therebetween;

immersing the fabric and backing sheet into an electrolytic solution containing a desired metallic ion for deposition on the fabric sheet, wherein the fabric and backing sheets are oriented and introduced into the solution so that air pockets are formed at the interstices, whereby only the backing sheet and a lower surface of each fiber are wetted;

positioning a first electrode against the fabric sheet;

positioning a second electrode against the lower peripheral surfaces of the fibers;

applying an electrical potential between the electrodes to generate an electric field through the fabric sheet to bond the metallic ions to the lower surfaces of the fibers; and removing the backing sheet.

10. The product made by the process of claim 9 wherein the backing sheet is made of paper and rubber cement is used to temporarily adhere the backing sheet to the upper side of the fabric sheet.

11. The product made by the process of claim 9 wherein the first electrode is an elongated conductive brush positioned external to the electrolytic solution.

12. The product made by the process of claim 11 wherein the second electrode is a conductive roller having a portion thereof immersed in the electrolytic solution and a portion in contact with the lower surfaces of the fibers in the sheet.

13. The product made by the process of claim 12 wherein the conductive roller has a fabric outer layer to absorb the electrolytic solution and provide a good conductive path to the fabric sheet.

14. The product made by the process of claim 13 wherein the conductive roller is made from graphite.

15. The product made by the process of claim 14 wherein the fabric sheet fibers are graphite.

16. The method of claim 9 wherein during the immersing step, the weave of the fabric is opened to fully expose the lower surfaces of the fibers to the solution.

17. The method of claim 11 wherein the fabric weave is opened by guiding the fabric and backing sheets under a roller immersed in the electrolytic solution, with the backing sheet positioned against a periphery of the roller.

18. A partially coated fibrous fabric sheet, made by a process comprising the steps of:

removably attaching a backing sheet to one side of a fabric sheet;

wetting a second side of the fabric sheet with an electrolytic solution containing metallic ions to be deposited on the second side of the sheet;

drawing the sheets between two electrodes while applying a voltage between the electrodes to bond the metallic ions to the second side of the fabric sheet; and removing the backing, whereby only the second side of the fabric sheet is plated and interstices between fabric fibers are open.

* * * * *